US007527342B2

(12) United States Patent
Lemm

(10) Patent No.: US 7,527,342 B2
(45) Date of Patent: May 5, 2009

(54) DRAWER STABILIZER AND SELF-CLOSER MECHANISM

(75) Inventor: Mike Lemm, Wauconda, IL (US)

(73) Assignee: Royal Hardware, Inc., Wauconda, IL (US)

( * ) Notice: Subject to any disclaimer, the term of this patent is extended or adjusted under 35 U.S.C. 154(b) by 427 days.

(21) Appl. No.: 11/121,567

(22) Filed: May 4, 2005

(65) Prior Publication Data

US 2006/0250059 A1 Nov. 9, 2006

(51) Int. Cl.
*A47B 88/12* (2006.01)

(52) U.S. Cl. ..... 312/331; 312/334.8

(58) Field of Classification Search ..... 312/330.1, 312/331, 334.1, 334.7, 334.8, 322, 323, 321; 384/20, 22

See application file for complete search history.

(56) References Cited

U.S. PATENT DOCUMENTS 1,178,877 A * 4/1916 Schaffert ..... 312/334.19
2,575,566 A * 11/1951 Shand ..... 312/334.15
3,093,429 A * 6/1963 Christen et al. ..... 312/331
3,339,995 A 9/1967 Bencene
3,748,005 A 7/1973 Chovanec
3,794,401 A 2/1974 Dean et al.
4,186,972 A 2/1980 Hagen
4,320,934 A 3/1982 Rock et al.
4,436,989 A 3/1984 Schuldt
4,925,258 A 5/1990 Ludwig et al.
5,895,102 A * 4/1999 Fleisch ..... 312/334.6

* cited by examiner

*Primary Examiner*—James O Hansen
(74) *Attorney, Agent, or Firm*—Vedder Price PC

(57) ABSTRACT

A drawer mechanism to moveably couple a drawer to a drawer support structure includes a pair of tracks that can be mounted to opposing inner sides of the drawer support structure. The mechanism further includes a pair of drawer stabilizer assemblies that can be mounted to opposing rear portions of the drawer. Each drawer stabilizer assembly can be moveably coupled with a corresponding track to provide opening and closing of the drawer. Each track includes a first section that is aligned with the direction of movement of the drawer and the second section that is substantially transverse to the direction of movement of the drawer. Each drawer stabilizer assembly includes a coupling mechanism that can couple the drawer stabilizer assembly to the second section of the track when the drawer is closed.

13 Claims, 3 Drawing Sheets

DRAWER STABILIZER AND SELF-CLOSER MECHANISM

FIELD OF THE DISCLOSURE

The present disclosure generally relates to drawer mechanisms, and more particularly, to a drawer stabilizer and self-closer mechanism.

BACKGROUND

Wide drawers or drawers that extend outside the cabinet to which they are mounted may experience racking and binding. Racking is the tendency of a drawer to change shape or shift side-to-side when moved toward the open or closed position by an off-axis force. Binding is when a lateral play in the drawer suspension device relative to the cabinet temporarily locks up the drawer when the drawer is being pulled out of or pushed into a cabinet. Various devices are available to prevent binding or racking of overly wide drawers and like structures. All such devices, however, are limited to a purely linear path of stabilizing elements. These devices are typically in the form of sliding bar linkages or rack and pinion mechanisms. Sliding bar linkages do not directly address the forces associated with racking, but rather provide linkages that limit the structural strength of the devices. Sliding bar linkages are dependent on torque vectors applied to the moving element, i.e., drawer. As such, they are least effective near the most important position of the moving element, which is a full extension of the moving element from the cabinet. Unless the moving element is quite rigid and the sliding bar link is quite lash-free, resistance to racking and binding will be marginal at best.

In most of these devices, the travel of the drawer is limited to less than the available cabinet depth. In addition, all of these devices are adversely affected by tolerance stack-up in the cabinet and drawer. Tolerance stack-up is the accumulation of variances from the nominal design dimensions of each component in an assembly. Some variance must be allowed in the manufacture of any component, due to the practical constraints on equipment and personnel in commercial production environments. Typically, an assembly achieves its function and is considered an acceptable design, despite a relatively wide variation in the physical attributes of components.

Therefore, there still remains a need for a mechanism to provide resistance to racking in overly wide drawers, particularly over a travel distance that could be somewhat greater than the depth of the cabinet in which the drawer is mounted.

SUMMARY

In accordance with a principal aspect of the present disclosure, a mechanism to moveably couple a drawer to a drawer support structure includes a pair of tracks mountable to opposing sides of the support structure, each track having a first section aligned with a direction of movement of the drawer and a second section configured substantially transverse to the direction of movement of the drawer. The disclosed mechanism further includes a pair of drawer stabilizer assemblies mountable to opposing rear portions of the drawer, each drawer stabilizer assembly configured to moveably couple with a corresponding track. The disclosed mechanism additionally includes a coupling mechanism to couple the drawer stabilizer assemblies to the second section of the track when the drawer is closed.

In accordance with another principal aspect of the present disclosure, a structure includes a drawer support structure having a pair of opposing inner side walls, at least one drawer, and at least one mechanism to moveably constrain the drawer in the drawer support structure. The mechanism includes a pair of tracks mounted to the opposing sidewalls, each track having a first section aligned with a direction of movement of the drawer at the front portion of the support structure and a second section configured substantially transverse to the direction of movement of the drawer at the rear portion of the support structure. The mechanism further includes a pair of drawer stabilizer assemblies mounted to opposing rear portions of the drawer, each drawer stabilizer assembly moveably coupled with a corresponding track. The mechanism additionally includes a coupling mechanism to couple the drawer stabilizer assemblies to the second section of the track when the drawer is closed.

In accordance with another principal aspect of the present disclosure, a mechanism to moveably couple a drawer to a drawer support structure includes a pair of tracks mountable to opposing sides of the support structure, each track having a first section aligned with a direction of movement of the drawer and a second section configured substantially transverse to the direction of movement of the drawer. The mechanism further includes a pair of drawer stabilizer assemblies mountable to opposing rear portions of the drawer, and a shaft rotatably coupled to the drawer stabilizer assemblies, the shaft having opposing ends, wherein each end of the shaft is moveably coupled to a corresponding one of the tracks.

BRIEF DESCRIPTION OF THE DRAWINGS

Certain embodiments are shown in the drawings. However, it is understood that the present disclosure is not limited to the arrangements and instrumentality shown in the attached drawings, wherein.

DETAILED DESCRIPTION

Figure 1:
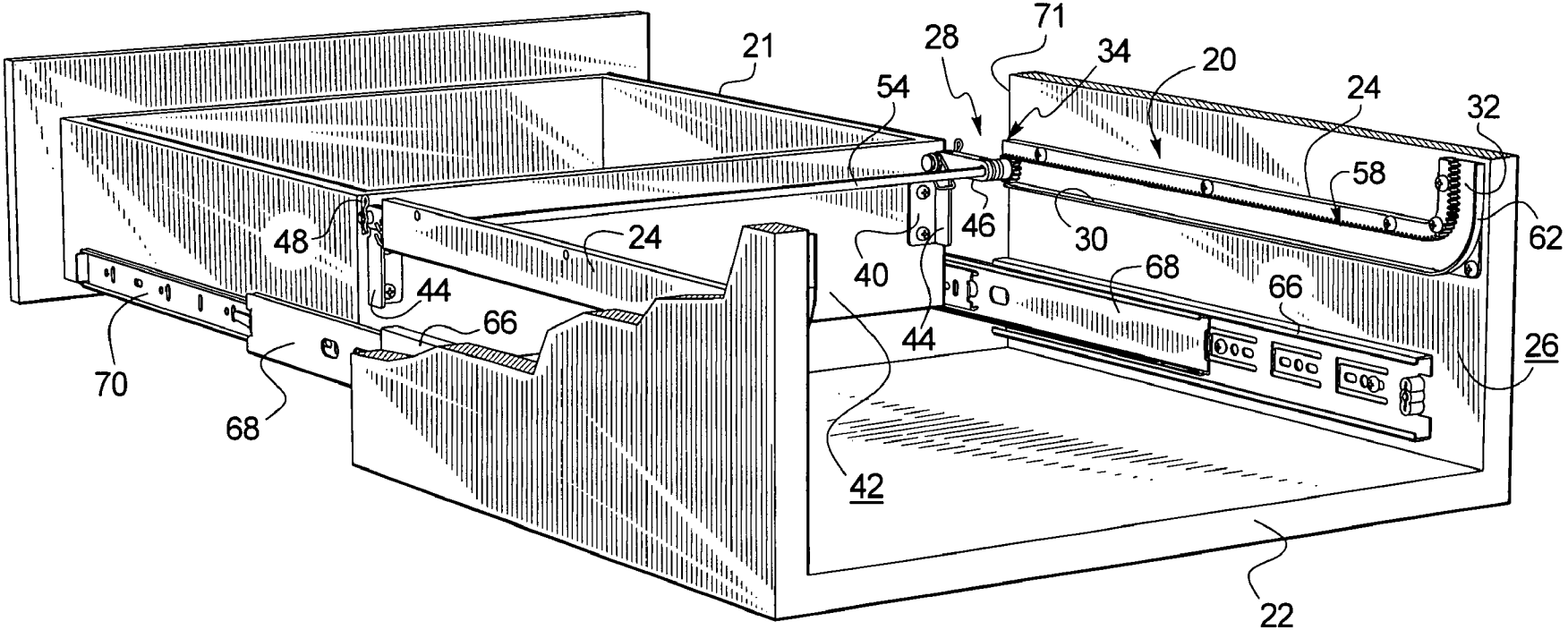
FIG. 1 illustrates a perspective fragmentary view of a cabinet and a drawer having a drawer stabilizer and self-closer mechanism constructed in accordance with the teachings of the present disclosure.

For the purposes of promoting and understanding the principles disclosed herein, reference will now be made to the preferred embodiments illustrated in the drawings and specific language will be used to describe the same. It will nevertheless be understood that no limitation of the scope is thereby intended. Such alterations and further modifications in the illustrated device and such further applications are the principles disclosed as illustrated therein as being contemplated as would normally occur to one skilled in the art to which this disclosure relates.

Referring to FIG. 1, a drawer mechanism 20 to moveably couple a drawer 21 to a drawer support structure 22 is shown. The mechanism 20 includes a pair of tracks 24 that can be mounted to opposing inner sides 26 of the drawer support structure 22. The drawer support structure 22 may be any type of rack, frame, cabinet, or any suitable structure that can slideably support a drawer 21. However, the drawer support structure 22 is referred to herein as the cabinet 22. The mechanism 20 further includes a pair of drawer stabilizer assemblies 28 that can be mounted to opposing rear portions of the drawer 21. Each drawer stabilizer assembly 28 can be moveably coupled with a corresponding track 24 to provide linear opening and closing of the drawer 21. Each track 24 includes a first section 30 that is aligned with the direction of movement of the drawer 21 and the second section 32 that is substantially transverse to the direction of movement of the drawer 21. Each drawer stabilizer assembly 28 includes a coupling mechanism 34 that can couple the drawer stabilizer assembly 28 to the second section 32 of the track 24 when the drawer 21 is closed.

Figure 2:
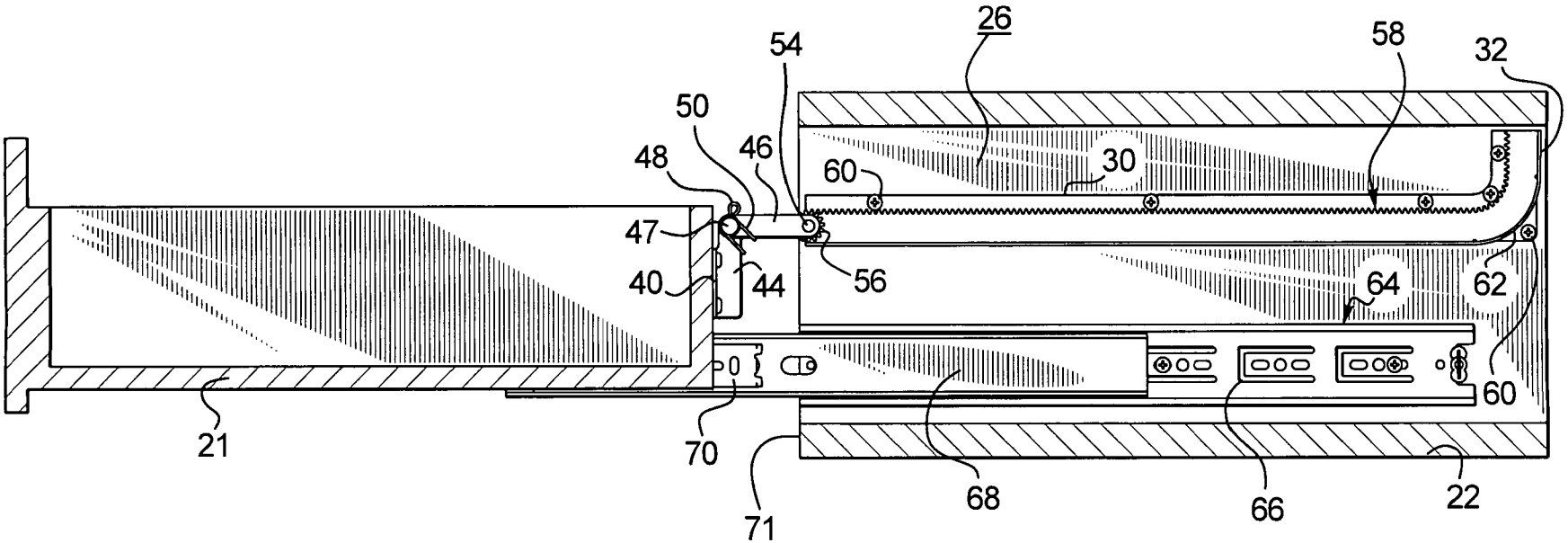
FIG. 2 illustrates a side view of the drawer stabilizer and self-closer mechanism of FIG. 1.
Figure 4:
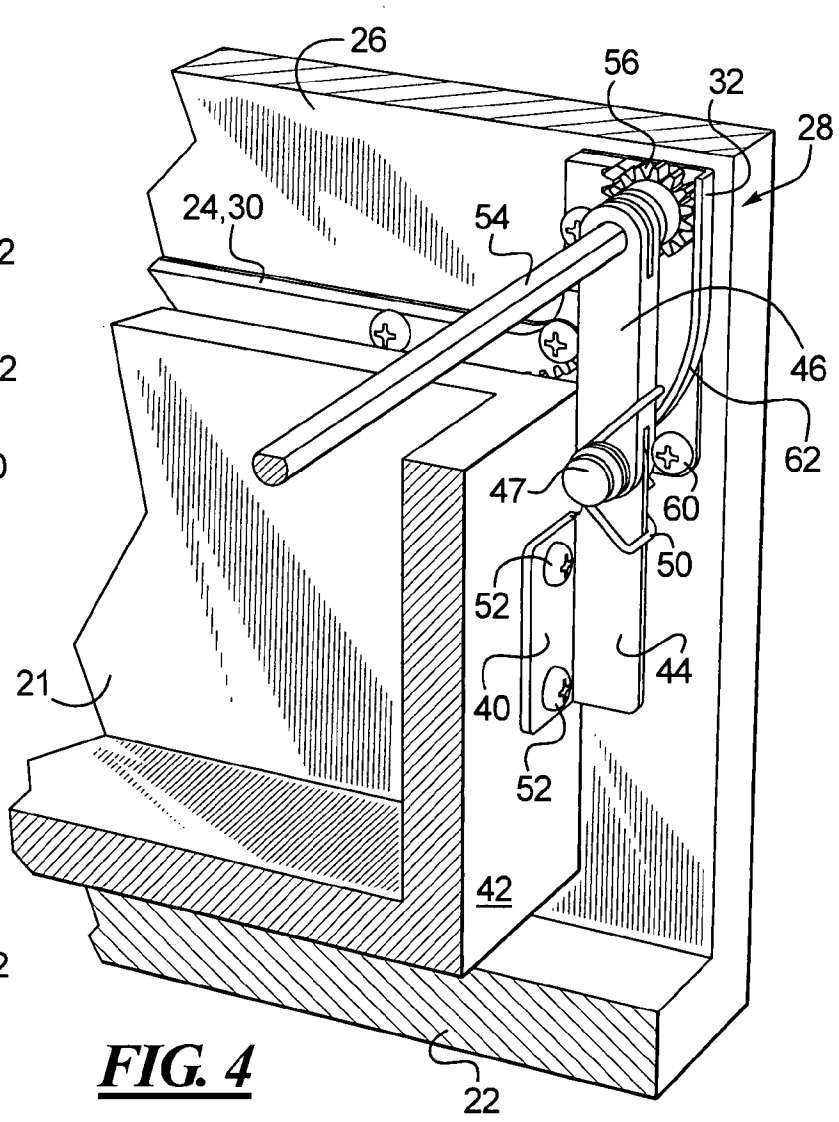
FIG. 4 illustrates a perspective fragmentary view of the drawer stabilizer and self-close mechanism of FIG. 1 shown with the drawer in the closed position.
Figure 3:
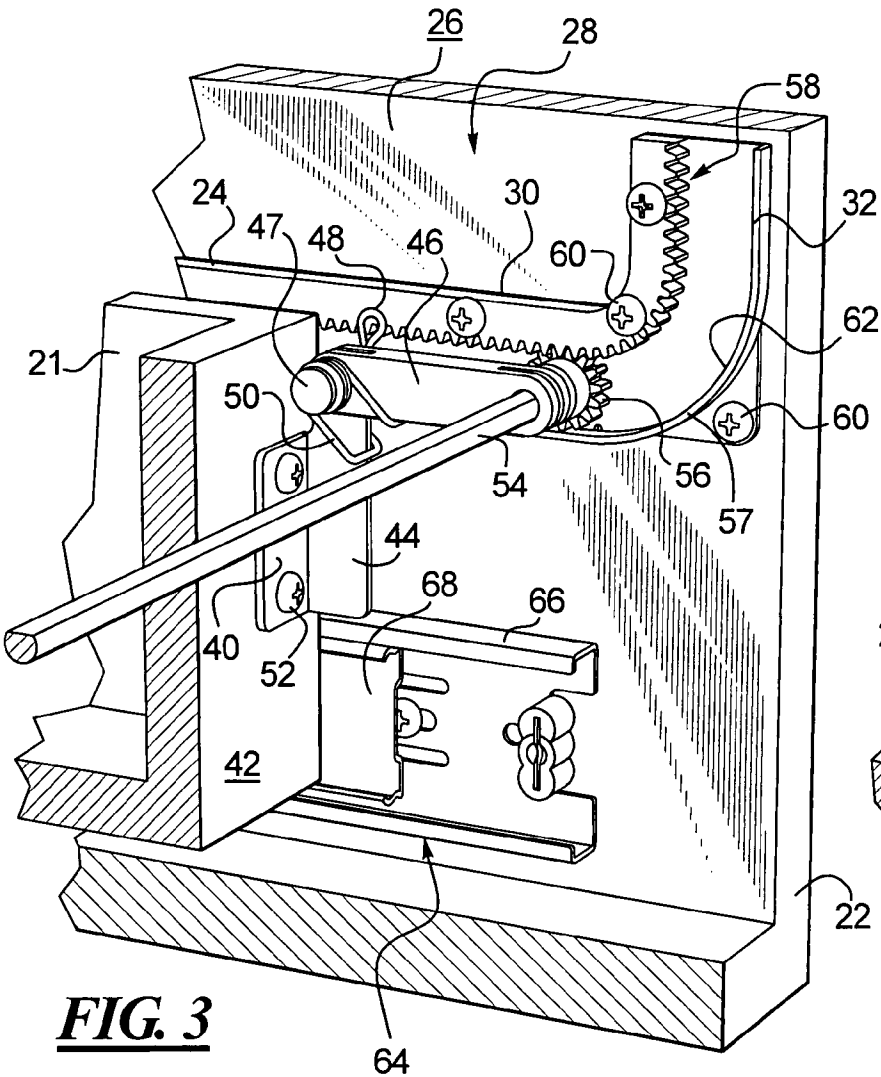
FIG. 3 illustrates a perspective fragmentary view of the drawer stabilizer and self-close mechanism of FIG. 1 shown with the drawer in a partially open position.

Referring to FIGS. 2-4, the drawer mechanism 20 is shown in more detail. The drawer mechanism 20 includes a pair of identical drawer stabilizer assemblies 28 and the corresponding tracks 24. Accordingly, only one of the drawer stabilizer assemblies 28 and the corresponding track 24 may be described with the understanding that the opposite side of the drawer 21 and the cabinet 22 also includes the identical structure. The drawer stabilizer assembly 28 includes a bracket 40 that provides attachment thereof to the rear wall 42 of the drawer 21. Although each drawer stabilizer assembly 28 is shown and described herein to be attached to the rear wall 42, each drawer stabilizer assembly 28 can be attached to any rear portion of the drawer 21 SO long as it can engage with a corresponding track 24. For example, the drawer stabilizer assembly may be attached to the rear outer sides (not shown) of the drawer 21 if sufficient space for such an attachment is provided between the drawer 21 and the inner sides 26 of the cabinet 22.

The drawer stabilizer assembly 28 further includes a first arm 44 and a second arm 46 that are pivotally connected together by a pin 47 that passes through overlapping apertures (not shown) of the first arm 44 and the second arm 46. The pin 47 may be maintained in position by a cotter pin 48. The pin 47 supports a spring 50 that is coupled to both the first arm 44 and the second arm 46 to bias the first arm 44 and the second arm 46 relative to each other. The bias in the spring 50 is configured to force the first arm 44 angularly apart from the second arm 46. Accordingly, reducing the angle between the first arm 44 and the second arm 46 will compress the spring 50. In the example disclosed herein, the spring 50 is a torsional spring. However, any type of spring can be used to bias the movement of the first arm 44 relative to the second arm 46. The first arm 44 may be attached to the bracket 40 or be integral with the bracket 40. In the disclosed examples, the bracket 40 and the first arm 44 are constructed from a one piece flange-shaped structure. The bracket 40 can be attached to the rear wall 42 of the drawer 21 with one or more fasteners 52.

The second arms 46 of the drawer stabilizer assemblies 28 are connected by a shaft 54. The shaft 54 can rotate and translate relative to the second arms 46 if necessary. Although not shown, a bearing may be disposed between the shaft 54 and the corresponding second arm 46 to provide rotation of the shaft 54 relative to the second arm 46. A pinion gear 56 is fixedly attached to each end (not shown) of the shaft 54. The shaft 54 is sized so that the pinion gears 56 at the ends thereof will be disposed in the track 24. However, the track 24 may include a lower lip portion 57 to prevent the departure of the pinion gear 56 therefrom. The track 24 includes a plurality of track teeth 58 that engage the teeth on the pinion gear 56 to allow rotation of the pinion gear 56 and the resulting translation of the pinion gear 56 relative to the track 24.

The track 24 can be attached to the inner sides 26 of the cabinet 22 with a plurality of fasteners 60. The track 24 includes a curved section 62 that connects the first section 30 to the second section 32 and provides a transition between the first section 30 and the second section 32. The first section 30, the second section 32 and the curved section 62 are contiguous and may be integrally constructed so as to provide a continuous track 24. The cabinet 22 also includes a suspension assembly 64 that slideably supports the drawer 21 when the drawer is pulled out of the cabinet 22 to open the drawer 21 and pushed into the cabinet 22 to close the drawer 21. The suspension assembly 64 may include a plurality of telescoping rails such as an outer rail 66 that may be attached to the inner sides 26 of the cabinet 22 and a middle rail 68, and inner rail 70 that can slide relative to the outer rail 66 and relative to each other to open and close the drawer 21 relative to the cabinet 22.

Referring to FIGS. 2 and 3, when the drawer is in the open position, the pinion gear 56 is disposed in the first section 30 of the track 24. In this position, the second arm 46 is positioned nearly perpendicular to the first arm 44 against the bias of this spring 50. Any movement of the drawer 21 in the open position, i.e. drawer being pulled out or pushed inward relative to the cabinet 22, causes the pinion gear 56 to rotate in the track 24. Because the pinion gears 56 of the drawer stabilizer assemblies 28 are connected to each other by the shaft 54, the rotation of the pinion gears 56 causes the rotation of the shaft 54. Accordingly, the speed of the pinion gears 56 become synchronized to provide a laterally stabilized and balanced open and close operation for the drawer 21. Furthermore, the shaft 54 in combination with the engagement of the pinion gears 56 with the track 24 provide lateral stability for the drawer 21 when it is pulled outward or pushed inward relative to the cabinet 22.

The first section 30 of the track 24 extends along the sidewall 26 of the cabinet 22 from nearly the front edge 71 of the inner sides 26 up to the curved section 62 of the track 24. Accordingly, when the drawer 21 is completely pulled out of the cabinet 22, as shown in FIG. 2, the pinion gear 56 of each drawer stabilizer assembly 28 is still engaged in the first track section 30. Therefore, the drawer mechanism 20 can provide lateral stability for the drawer 21 even when the drawer 21 is fully extended from the cabinet 22.

When the drawer 21 is moved toward a closed position, the pinion gear 56 of each drawer stabilizer assembly 28 reaches the curved section 62 of the track 24. Pushing the drawer 21 further inward into the cabinet 22 will cause the pinion gear 56 to traverse through the curved section 62. When the drawer 21 is in open position, the first arm 44 and the second arm 46 are positioned nearly perpendicular to each other. In this position the spring 50 is under compression. When the pinion gear 56 reaches the curved section 62 of the track 24, the bias in the spring 50 assists the pinion gear 56 to traverse through this curved section 62 by forcing apart the first arm 44 and the second arm 46. Accordingly, because of the bias in the spring 50, as soon as the drawer 21 is pushed far enough in the cabinet 22 SO that the pinion gear 56 reaches the curved section 62, the bias in the spring 50 may assist in the closing of the drawer 21 by forcing the pinion gear 56 to traverse through the curved section 62 and the second track section 32 to close the drawer 21. Therefore, a user may only need to close the drawer 21 far enough so that the pinion gear 56 reaches the curved section 62 of the track 24. Thereafter, the bias in the spring 50 will complete the closing of the drawer by forcing apart the arms 42 and 44 to move the pinion gear 56 to the second section 32 of the track 24. Therefore, the first arm 44, the second arm 46, the spring 50, the curved section 62 of the track 24, and the second section 32 of the track 24 define the coupling mechanism 34 that can couple the drawer stabilizer assembly 28 to the second section 32 of the track 24 when the drawer 21 is closed.

In the closed position of the drawer 21, as shown in FIG. 2, the first arm 44 and the second arm 46 are nearly aligned with each other and the pinion gear 56 of each coupling mechanism 34 is positioned in the second track section 32. The drawer 21 will remain in the closed position, because the spring 50 will prevent the pinion gear 56 to move downward toward the curved section 62 to open the drawer 21. The drawer 21 can be opened if a user pulls on the drawer 21 to compress the spring 50. Therefore, the drawer mechanism 50 provides lateral stability for the drawer 21 over its travel and a self-closing mechanism when the drawer is placed near the closed position.

Although the pinion gear 56 is shown and described herein to be a small wheel with teeth that engage the corresponding track teeth 58, one of ordinary skill in the art will readily appreciate that the pinion gear 56 may simply be a roller that engages a toothless track to provide self-closing of the drawer 21 as described in the foregoing. The drawer stabilizer assembly 28 and the track 24 may be constructed from low friction materials that can include a variety of plastic materials. Alternatively, the drawer stabilizer assembly 28 and the track 24 may be constructed from metallic materials an provided with lubrication if necessary. The above described drawer mechanism 20 represents one example of a drawer mechanism that can be constructed in accordance with the teachings of the present disclosure. Therefore, one of ordinary skill in the art will appreciate the numerous configurations for the mechanism 20 that can be constructed without departing from the teachings of the present disclosure.

Furthermore, while the particular preferred embodiments have been shown and described, it will be obvious to those skilled in the art that changes and modifications may be made without departing from the teaching of the disclosure. The matter set forth in the foregoing description and accompanying drawings is offered by way of illustration only and not as limitation. The actual scope of the disclosure is intended to be defined in the following claims when viewed in their proper perspective based on the related art.

What is claimed is:

1. A mechanism to moveably couple a drawer to a drawer support structure, the mechanism comprising:

a pair of tracks mountable to opposing sides of the support structure, each track having a first section aligned with a direction of movement of the drawer and a second section configured substantially transverse to the direction of movement of the drawer;

a pair of drawer stabilizer assemblies mountable to opposing rear portions of the drawer, each drawer stabilizer assembly configured to moveably couple with a corresponding track;

a coupling mechanism to couple the drawer stabilizer assemblies to the second section of the track when the drawer is closed;

a first arm mountable to a corresponding rear portion of the drawer;

a second arm pivotally coupled to the first arm;

a spring coupled to the first arm and the second arm to bias the movement of the first arm angularly apart from the second arm relative to each other, wherein the first arm and the second arm are substantially perpendicular to each other when the drawer is disposed in an open position, and aligned to each other when the drawer is disposed in a closed position; and a wheel coupled to the second arm and configured to rotatably couple to a corresponding one of the tracks.

2. The drawer mechanism of claim 1, wherein the track includes an edge portion configured to prevent the wheel from decoupling from the track.

3. The drawer mechanism of claim 1, wherein the wheel is a gear, and wherein the track includes plurality of track teeth to engage the gear.

4. The drawer mechanism of claim 1, further comprising a shaft, wherein each wheel is coupled to an end of the shaft, and wherein the shaft is rotatably coupled to the second arms.

5. A structure comprising:

a drawer support structure having a pair of opposing inner side walls;

at least one drawer;

at least one mechanism to moveably constrain the drawer in the drawer support structure, the mechanism comprising:

a pair of tracks mounted to the opposing sidewalls, each track having a first section aligned with a direction of movement of the drawer at the front portion of the support structure and a second section configured substantially transverse to the direction of movement of the drawer at the rear portion of the support structure;

a pair of drawer stabilizer assemblies mounted to opposing rear portions of the drawer, each drawer stabilizer assembly moveably coupled with a corresponding track;

a coupling mechanism to couple the drawer stabilizer assemblies to the second section of the track when the drawer is closed; and a first arm mountable to a corresponding rear portion of the drawer;

a second arm pivotally coupled to the first arm;

a spring coupled to the first arm and the second arm to bias the movement of the first arm angularly apart from the second arm relative to each other, wherein the first arm and the second arm are substantially perpendicular to each other when the drawer is disposed in an open position, and aligned to each other when the drawer is disposed in a closed position; and a wheel coupled to the second arm and configured to roll on the corresponding one of the tracks.

6. The structure of claim 5, wherein the track includes an edge portion configured to prevent the wheel from decoupling from the track.

7. The structure of claim 5, wherein the wheel is a gear, and wherein the track includes plurality of track teeth to engage the gear.

8. The structure of claim 5, further comprising a shaft, wherein each wheel is coupled to an end of the shaft, and wherein the shaft is rotatably coupled to the second arms.

9. A mechanism to moveably couple a drawer to a drawer support structure, the mechanism comprising:

a pair of tracks mountable to opposing sides of the support structure, each track having a first section aligned with a direction of movement of the drawer and a second section configured substantially transverse to the direction of movement of the drawer;

a pair of drawer stabilizer assemblies mountable to opposing rear portions of the drawer;

a shaft rotatably coupled to the drawer stabilizer assemblies, the shaft having opposing ends, wherein each end of the shaft is moveably coupled to a corresponding one of the tracks; and a first arm mountable to a corresponding rear portion of the drawer;

a second arm pivotally coupled to the first arm; and a spring coupled to the first arm and the second arm to bias the movement of the first arm angularly apart from the second arm relative to each other, wherein the first arm and the second arm are substantially perpendicular to each other when the drawer is disposed in an open position, and aligned to each other when the drawer is disposed in a closed position;

wherein the shaft is rotatably coupled to the second arm.

10. The mechanism of claim 9, further comprising a pair of wheels, each wheel being coupled to a corresponding end of the shaft, wherein each wheel is rotatably coupled to a corresponding track.

11. The mechanism of claim 10, wherein the track includes an edge portion configured to prevent the wheel from decoupling from the track.

12. The mechanism of claim 10, wherein the wheel is a gear, and wherein the track includes plurality of track teeth to engage the gear.

13. The mechanism of claim 9, wherein the first section of each track substantially extends up to a front opening of the support structure to allow the drawer to be pulled out beyond the front opening.

* * * * *